US006272719B2

(12) United States Patent
Wu

(10) Patent No.: US 6,272,719 B2
(45) **Date of Patent: *Aug. 14, 2001**

(54) DUST-COLLECTING BARROW

(75) Inventor: Yi-Jen Wu, Hsinchu (TW)

(73) Assignee: Winbond Electronics Corp., Hsinchu (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/250,748

(22) Filed: Feb. 16, 1999

(30) Foreign Application Priority Data

Dec. 3, 1998 (TW) ..... 87120061

(51) Int. Cl.[7] ..... A47L 9/10
(52) U.S. Cl. ..... 15/353; 96/350; 261/119.1
(58) Field of Search ..... 15/347, 353; 261/119.1; 96/348, 350

(56) References Cited

U.S. PATENT DOCUMENTS 923,547 * 6/1909 Mayo et al. ..... 15/353 X
1,014,027 * 1/1912 Walter ..... 15/353
1,788,410 * 1/1931 Runyon ..... 261/119.1 X
1,832,245 * 11/1931 Runyon ..... 96/350
4,172,865 * 10/1979 Steier ..... 261/119.1 X
4,358,300 * 11/1982 Schlapman et al. ..... 261/119.1 X
5,210,902 * 5/1993 Lee et al. ..... 15/353 X

* cited by examiner

*Primary Examiner*—Chris K. Moore
(74) *Attorney, Agent, or Firm*—Jiawei Huang; J.C. Patents

(57) ABSTRACT

Disclosed is a dust-collecting barrow according to the invention. The dust-collecting barrow has a layer of silicon oil on the bottom thereof. The silicon oil is stable; that is, it is difficult for it to react with chemical compounds. The dust-collecting barrow has a plurality of alternately-arranged dividers. When chemical materials and/or particles are sucked into the dust-collecting barrow, heavier materials are first deposited in the silicon oil while lighter materials continuously move forward, and then are deposited in the silicon oil. Furthermore, the dust-collecting barrow is divided by the alternatively-arranged dividers into a plurality of open spaces which are used to absorb various chemical materials or particles, thereby preventing the various chemical materials or particles from reacting with each other.

24 Claims, 3 Drawing Sheets

DUST-COLLECTING BARROW

CROSS-REFERENCE TO RELATED APPLICATION

This application claims the priority benefit of Taiwan application Ser. No. 87120061, filed Dec. 3, 1998, the full disclosure of which is incorporated herein by reference.

BACKGROUND OF THE INVENTION

1. Field of the Invention

The invention relates to a dust-collecting device, and in particular to a dust-collecting barrow, which uses a suction force to collect various chemical materials or particles.

2. Description of the Related Art

In IC manufacturing, an extremely high cleanliness class is required to manufacture ICs with expected functions. Also, IC integrity is further increased in current semiconductor technology development. Therefore, it is important to clean semiconductor-manufacturing equipment with chemical materials and dust particles remaining thereon, including dust-free chambers for manufacturing high-performance semiconductor devices.

In the processes of prior art, a dust-free wiper is mainly used to clean contaminated parts of semiconductor equipment including dust-free chambers. During cleaning with the dust-free wiper, chemical materials and/or dust particles can adhere to the wiper. If the used wiper is not carefully and well disposed of, the chemical materials and/or dust particles, such as polymers and/or metal particles stuck on the wiper can react with each other, resulting in the generation of toxic products and/or even an accident caused by drastic explosions. This seriously affects the environmental safety, especially with regard to the dust-free chambers.

Furthermore, low vacuum devices in dust-free chambers are only used to clean chemical products, such as polymers, produced therein, and have no additional functions.

SUMMARY OF THE INVENTION

In view of the above, a first object of the invention is to provide a dust-collecting barrow in which a silicon oil that has a chemical stability and is unable to react with other materials is used to absorb various chemical polymers or particles.

A second object of the invention is to provide a dust-collecting barrow in which a great number of opening spacers are formed, into which various chemical polymers or particles are collected by the generation of a low vacuum, wherein the various collected chemical polymers or particles are deposited in different spaces according to weights and sizes thereof, so that the various chemical polymers or particles can be prevented from reacting with each other.

A third object of the invention is to provide a dust-collecting barrow which has a better mobility, is easily cleaned, and can be repeatedly used.

To achieve the above-stated objects, the dust-collecting barrow, suitable for use in a dust-free chamber in a semiconductor factory, includes a barrow body, a barrow base, a suction hose and a low vacuum hose. In the barrow body, a plurality of dividers are alternately arranged to form a plurality of open spaces and a passage. Furthermore, the barrow body has a first hole and a second hole, which are connected to the suction hose and the low vacuum hose, respectively. The barrow base is located on the bottom of the barrow body and has a layer of oil located thereon, which oil is used to absorb various chemical polymers, metal particles or dust particles. The chemical polymers, metal particles or dust particles are collected into the dust-free barrow by a low vacuum suction force through the suction hose. Once inside the dust-barrow, the collected chemical polymers, metal particles or dust particles are deposited in different open spaces along the passage according to the weights and sizes thereof. The heaviest or largest chemical polymers, metal particles or dust particles in weight and size are first deposited in a first space, next heaviest or largest chemical polymers, metal particles or dust particles are deposited in a second space, and so on. The number of the spaces depends on practical requirements. Moreover, the barrow base has a set of wheels while the barrow body has a handle for easy pushing. The barrow base has oil-draining holes formed therein.

In the dust-collecting barrow of the invention, since the layer of oil is chemically stable and does not react with other chemical materials, the oil can be used to absorb chemical materials. Furthermore, the absorbed chemical materials are deposited in different spaces according to the different weights thereof. It is obvious that the absorbed chemical materials which are deposited in the different spaces filled with the oil cannot react with each other. Therefore, the dust-collecting barrow according to the invention can categorically collect chemical polymers. metal particles and dust particles.

For convenient operation, the dust-collecting barrow has a set of wheels and a handle. Therefore, the dust-collecting barrow has advantages of being able to speedily maintain and clean equipment including a dust-free chamber.

BRIEF DESCRIPTION OF THE DRAWINGS

The invention will become more fully understood from the detailed description given hereinbelow and the accompanying drawings which are given by way of illustration only, and thus do not limit the present invention, and wherein.

DETAILED DESCRIPTION OF THE PREFERRED EMBODIMENT

Figure 1A:
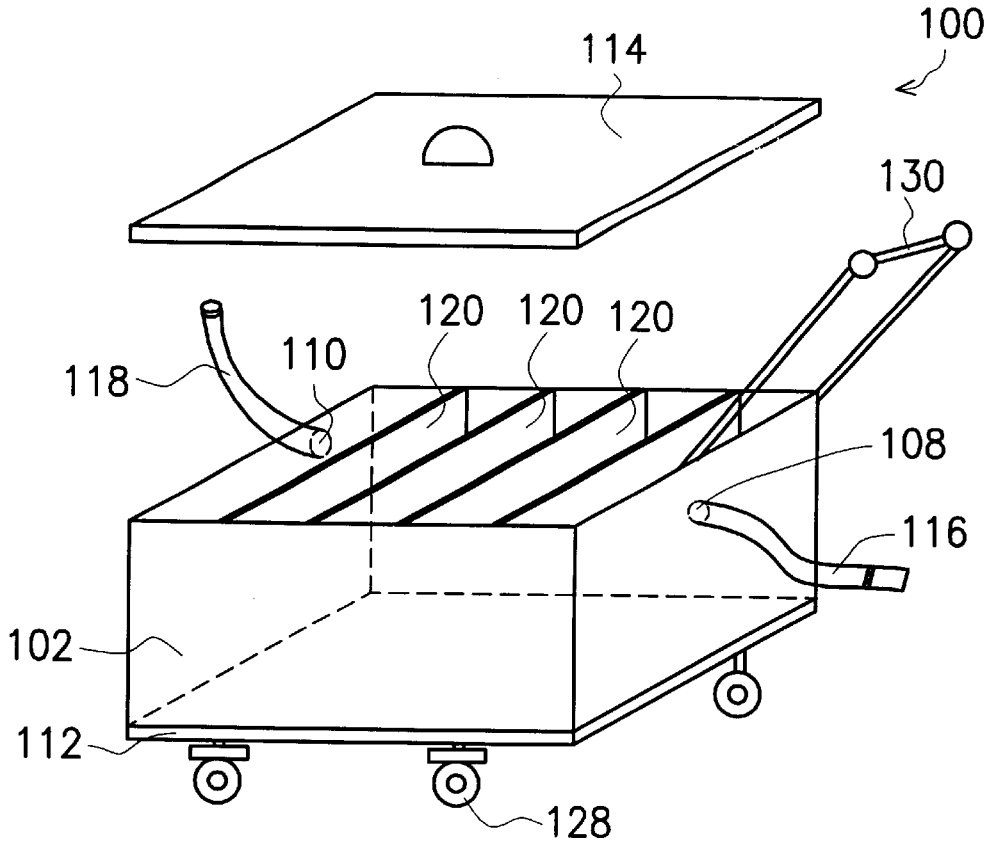
FIG. 1A is a schematic, perspective view illustrating a dust-collecting barrow according to a preferred embodiment of the invention.

FIG. 1A is a schematic, perspective view illustrating a dust-collecting barrow 100 according to a preferred embodiment of the invention. The dust-collecting barrow 100 that is suitable for cleaning equipment including dust-free chambers in a semiconductor factory mainly includes a barrow body 102, a barrow base 112 and a top cover 114. The barrow base 112 is located on the bottom of the barrow body 102, while the top cover 114 is used to cover the barrow body 102.

Figure 1B:
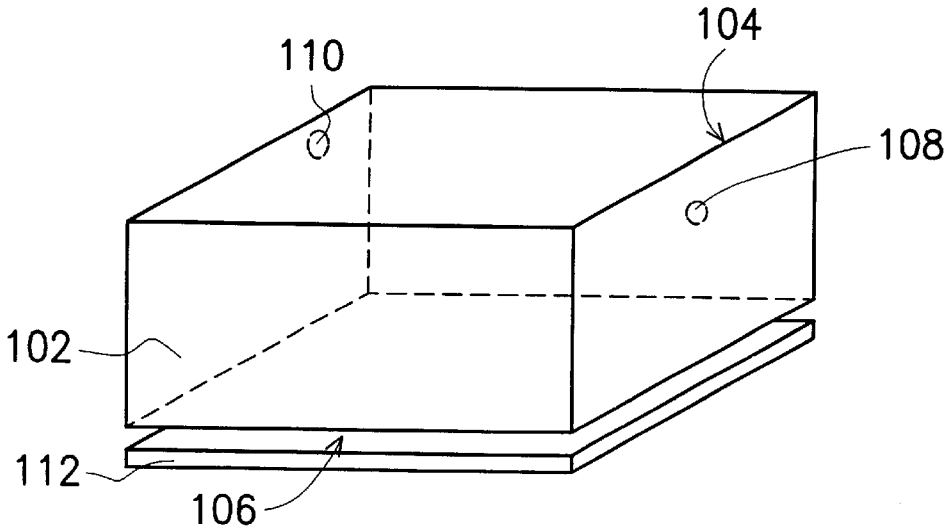
FIG. 1B is a schematic, perspective view illustrating a barrow body and a barrow base of the dust-collecting barrow of FIG. 1A.

FIG. 1B is a schematic, perspective view illustrating the barrow body 102 and the barrow base 112 of the dust-collecting barrow 100 of FIG. 1A. Referring to FIG. 1B, the barrow body 102 includes a top peripheral edge 104 and a bottom peripheral edge 106. With the support of part of the top peripheral edge 104, the top cover 114 can cover the top of the barrow body 102, wherein the top peripheral edge 104 is an independent structure. The part of the bottom peripheral edge 106 is securely joined to the barrow base, wherein the bottom peripheral edge 106 can be an independent structure or can be formed in one piece together with the barrow body 102. The inner surface of the top cover 114 is mirror-processed with stainless steel, such as SUS304-type stainless steel, and therefore, can withstand corrosion and rust, and can be easily cleaned. Since it is easy to corrode the dust-collecting barrow during absorption of chemical products, such as polymers, a proper mirror process is indeed required.

Moreover, the barrow body 102 has a first hole 108 and a second hole 110 which are connected to a low vacuum hose 116 and a suction hose 118, respectively. The low vacuum hose 116 is also connected to a low vacuum pump which generates a suction force to collect materials, such as chemical products including polymers, metal particles, dust particles, nails and bolts, into the dust-collecting barrow 100, wherein the suctioned materials are deposited on the barrow base 112.

Figure 2A:
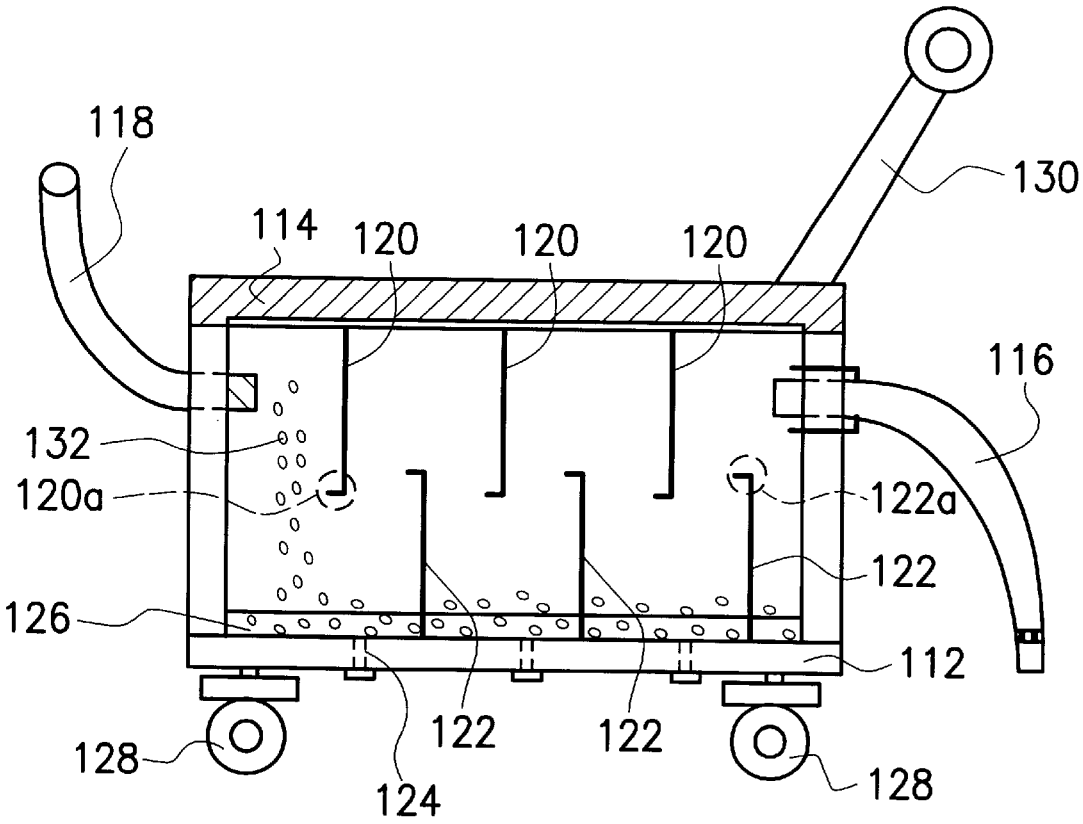
FIG. 2A is a schematic, cross-sectional view of the dust-collecting barrow of FIG. 1A.

FIG. 2A is a schematic, cross-sectional view of the dust-collecting barrow 100 of FIG. 1A. As shown in FIG. 2A, a layer of oil 126, such as a silicon oil, is filled in and located on the barrow base 112. The silicon oil is chemically stable, and does not easily react with other chemical materials. Therefore, the silicon oil can be used to absorb materials, such as chemical polymers, metal particles and dust particles. The absorbed materials are deposited in the silicon oil 126.

Furthermore, since the barrow base 112 has a plurality of oil-draining holes 124, it is convenient to drain oil or discharge the materials absorbed by the silicon oil 126 when the oil in the dust-collecting barrow 100 is changed.

Figure 2B:
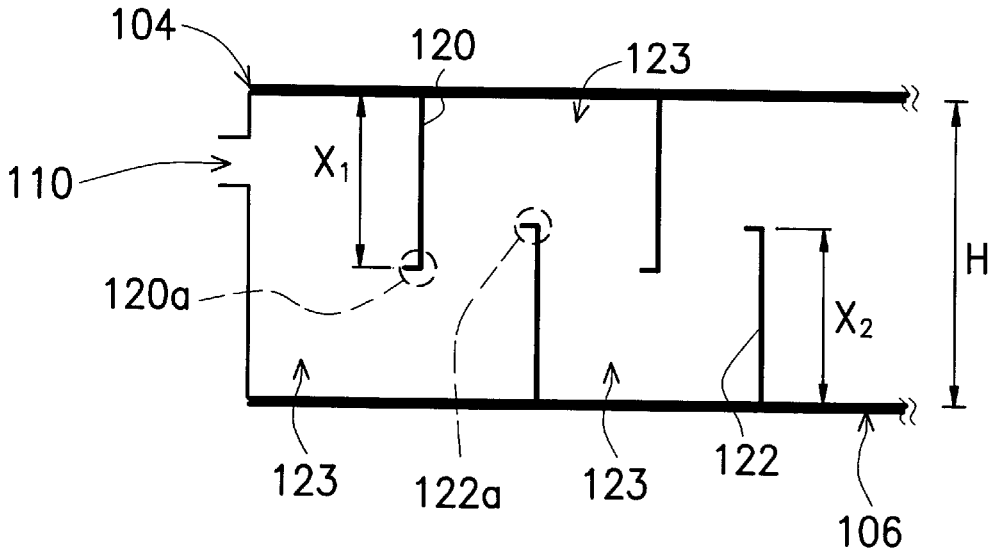
FIG. 2B is a schematic cross-sectional view showing the arrangement of dividers in the dust-collecting barrow of FIG. 1A.

Additionally, the dust-collecting barrow 100 includes a plurality of first dividers 120 and a plurality of second dividers 122 which are alternately arranged between the top cover 114 and the barrow base 112, thereby to divide the barrow body 102 into a plurality of open spaces 123. FIG. 2B is a schematic cross-sectional view showing the arrangement of the dividers 120, 122 in the dust-collecting barrow 100 of FIG. 1A. As shown in FIG. 2B, the lengths of the first dividers and the second dividers X1 and X2 are smaller than the height H of the barrow body 102, such that the divided spaces 123 are incompletely separated from each other. In other word, the spaces 123 can communicate with each other. To keep the divided spaces 123 in communication with each other, the level of the silicon oil layer 126 is always kept much lower than a top end of the second dividers 122, as shown in FIG. 2A. That is, the level of the silicon oil layer 126 is lower than the lower ends of the first dividers 120. Moreover, first divider 120 is aligned with, and joined to, the top peripheral edge 104, and has two edges connected to the barrow body 102 while one edge of each second divider 122 is connected to the barrow base 112. Edges of each first divider 120 and each second divider 122 that are close to the center of the barrow body 102 have hook-shaped structures 120*a* and 122*a*, which are used to block collected materials. The first and second dividers 120 and 122 can be made of metal, stainless steel or other materials with the same function.

Figure 3:
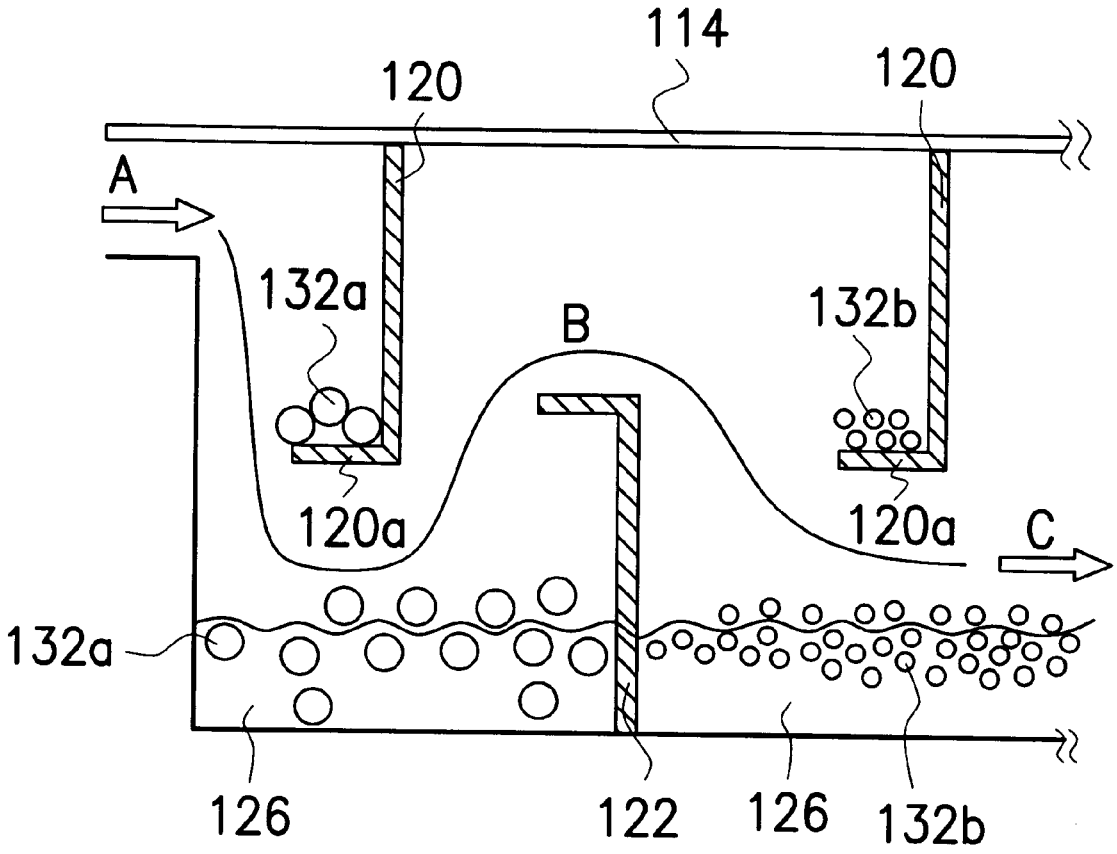
FIG. 3 is an amplified, cross-sectional view of the dust-collecting barrow of FIG. 1A illustrating how chemical materials or particles are deposited in various open spaces after being collected into the barrow.

FIG. 3 is an amplified, cross-sectional view of the dust-collecting barrow 100 of FIG. 1A, illustrating how chemical materials or particles are deposited in various open spaces 123 after being collected into the dust-collecting barrow 100. As shown in FIG. 3, a suction force indicated by a direction C shown in FIG. 3 is provided by the low vacuum hose 116 to form a path B in the dust-collecting barrow 100. As is obvious from FIG. 3, materials including larger, heavier particles 132*a* and smaller, lighter particles 132*b* are sucked into the dust-collecting barrow 100 through an inlet A by the suction force provided by the vacuum hose 116. After that, the larger, heavier particles 132*a* are first deposited in the silicon oil 126, or blocked by the hook-shaped structure 120*a* at an edge of a corresponding divider 120. That is, the larger, heavier particles cannot be transmitted into the next opening space 123. The smaller, lighter materials 132*b* are transmitted into the next opening space 123, and then deposited in the silicon oil 126, and so on.

As described above, collected materials are deposited in order in the silicon oil 126 according, to the weights thereof. Since various materials are collected and categorically deposited in the silicon oil 126, which is chemically stable, the various materials cannot react with each other. Accordingly, chemical materials and/or particles, including even nails, can be separately collected by the dust-collecting barrow of the invention.

Referring again to FIGS. 1A and 2A, a set of wheels 128 can further be installed under the barrow base 112 for a higher mobility. Moreover, a handle 130 can be installed on the barrow body 102 for convenient operation.

In summary, the dust-collecting barrow according to the invention can be used to prepare more efficient and cleaner equipment, including dust-free chambers, and has no problem of instability and disadvantages caused by cleaning equipment with a dust-free wiper as stated in the prior art.

Furthermore, a first feature of the invention is that the silicon oil used in the invention is chemically stable and does not easily react with other materials; therefore, the oil can absorb various chemical polymers or particles.

A second feature of the invention is that a plurality of open spaces is formed in the dust-collecting barrow, and various chemical polymers and/or particles sucked into the dust-collecting barrow by the generation of low vacuum are categorically deposited in different spaces according to the weights of the collected materials. Therefore, the collected materials cannot react with each other.

A third feature of the invention is that the dust-collecting barrow of the invention can be conveniently removed, easily cleaned and repeatedly used.

While the invention has been described by way of example and in terms of the preferred embodiment, it is to be understood that the invention is not limited to the disclosed embodiment. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A dust-collecting barrow comprising:

a barrow body having a first hole and a second hole formed thereon, wherein an inner part of the barrow body is divided into a plurality of open spaces that are not completely separated from each other;

a barrow base located on the bottom of the barrow body and having a layer of oil located thereon, such that the open spaces are not blocked by the layer of oil;

a suction hose connected to the first hole for sucking chemical materials or particles into the barrow body;

a low vacuum hose, of which one end is connected to the second hole, and another end is connected to a vacuum device which provides a suction force;

wherein the barrow body comprises a top peripheral edge and a bottom peripheral edge; and a plurality of first dividers with a length shorter than a height of the barrow body located therein, wherein each first divider is joined to the top peripheral edge; and a plurality of second dividers, with a length shorter than a height of the barrow body, located therein, wherein each second divider has one edge connected to the barrow base and is alternately arranged with respect to the first dividers, thereby to form the open spaces.

2. The dust-collecting barrow of claim 1, wherein the barrow base is securely joined to the bottom peripheral edge.

3. The dust-collecting barrow of claim 1, farther comprising a top cover which is used to cover the top of the barrow body with the support of the top peripheral edge.

4. The dust-collecting barrow of claim 1, wherein the barrow base and the barrow body are formed in one piece.

5. The dust-collecting barrow of claim 1, wherein the barrow base has a plurality of oil-draining holes formed therein.

6. The dust-collecting barrow of claim 1, wherein the barrow body comprises a handle on a surface of the barrow body.

7. The dust-collecting barrow of claim 1, wherein the oil is a silicon oil.

8. The dust-collecting barrow of claim 1, wherein the inner surface of the top cover is mirror-processed.

9. The dust-collecting barrow of claim 1, wherein the inner surface of the top cover is made of stainless steel.

10. The dust-collecting barrow of claim 9, wherein the stainless steel is SUS304-type stainless steel.

11. A dust-collecting barrow comprising:

a barrow body having a top peripheral edge and a bottom peripheral edge, and having a first hole and a second hole formed thereon;

a barrow base securely joined to the bottom peripheral edge on the bottom of the barrow body and having a layer of oil located thereon;

a plurality of first dividers with upper ends attached to the top peripheral edge and lower ends hanging inside of the barrow body;

a plurality of second dividers with a length shorter than a height of the barrow body, wherein each second divider has one edge connected to the barrow base and is alternately arranged with respect to the first dividers, thereby to form the open spaces;

a top cover used to cover the top of the barrow body with the support of the top peripheral edge;

a suction hose connected to the first hole for collecting chemical material or particles; and a low vacuum hose of which one end is connected to the second hole and another end is connected to a low vacuum device which provides a suction force.

12. The dust-collecting barrow of claim 11, wherein the barrow base and the barrow body are formed in one piece.

13. The dust-collecting barrow of claim 11, wherein the barrow base has a plurality of oil-draining holes formed therein.

14. The dust-collecting barrow of claim 11, wherein the barrow base comprises a set of wheels.

15. The dust-collecting barrow of claim 11, wherein the barrow body has a handle installed thereon.

16. The dust-collecting barrow of claim 11, wherein the oil is a silicon oil.

17. The dust-collecting barrow of claim 11, wherein the inner surface of the top cover is mirror processed.

18. The dust-collecting barrow of claim 17, wherein the inner surface of the top cover is made of stainless steel.

19. The dust-collecting barrow of claim 18, wherein the stainless steel is SUS304-type stainless steel.

20. The dust-collecting barrow of claim 11, wherein each of the lower ends of the first dividers and upper ends of the second dividers has a hook shaped structure.

21. The dust-collecting barrow of claim 11, wherein the first and second dividers are arranged to form a plurality of open spaces that allow a continuous dust-collecting path between the suction hose and the low vacuum hose.

22. A dust-collecting barrow comprising:

a barrow body having a first hole and a second hole formed thereon, wherein an inner part of the barrow body is divided into a plurality of open spaces that are not completely separated from each other;

a barrow base located on the bottom of the barrow body and having a layer of oil located thereon, such that the open spaces are not blocked by the layer of oil;

a suction hose connected to the first hole for sucking chemical materials or particles into the barrow body;

a low vacuum hose, of which one end is connected to the second hole, and another end is connected to a vacuum device which provides a suction force;

wherein the barrow body comprises a top peripheral edge and a bottom peripheral edge; and a plurality of first dividers with a length shorter than a height of the barrow body located therein, wherein each first divider is joined to the top peripheral edge; and a plurality of second dividers, with a length shorter than a height of the barrow body located therein, wherein each second divider has one edge connected to the barrow base and is alternately arranged with respect to the first dividers, thereby to form the open spaces; and further wherein each of the lower ends of the first dividers and the upper ends of the second dividers have a hook shaped structure.

23. A dust-collecting barrow comprising:

a barrow body having a first hole and a second hole formed thereon, wherein an inner part of the barrow body is divided into a plurality of open spaces that are not completely separated from each other;

a barrow base located on the bottom of the barrow body and having a layer of oil located thereon, such that the open spaces are not blocked by the layer of oil;

a suction hose connected to the first hole for sucking chemical materials or particles into the barrow body;

a low vacuum hose, of which one end is connected to the second hole, and another end is connected to a vacuum device which provides a suction force;

wherein the barrow body comprises a top peripheral edge and a bottom peripheral edge; and a plurality of first dividers with a length shorter than a height of the barrow body located therein, wherein each first divider is joined to the top peripheral edge; and a plurality of second dividers, with a length shorter than a height of the barrow body located therein, wherein each second divider has one edge connected to the barrow base and is alternately arranged with respect to the first dividers, thereby to form the open spaces; and further wherein edges of each first divider and each second divider approximately close to the center of the barrow body are of hook-shaped structure.

24. A dust-collecting barrow comprising:

a barrow body having a first hole and a second hole formed thereon, wherein an inner part of the barrow body is divided into a plurality of open spaces that are not completely separated from each other;

a barrow base located on the bottom of the barrow body and having a layer of oil located thereon, such that the open spaces are not blocked by the layer of oil;

a suction hose connected to the first hole for sucking chemical materials or particles into the barrow body;

a low vacuum hose, of which one end is connected to the second hole, and another end is connected to a vacuum device which provides a suction force;

wherein the barrow body comprises a top peripheral edge and a bottom peripheral edge;

and a plurality of first dividers with a length shorter than a height of the barrow body located therein, wherein each first divider is joined to the top peripheral edge; and a plurality of second dividers, with a length shorter than a height of the barrow body, located therein, wherein each second divider has one edge connected to the barrow base and is alternately arranged with respect to the first dividers, thereby to form the open spaces;

whereby various chemical polymers or particles are collected by the generation of a low vacuum in the said dust-collecting barrow; and whereby the various collected chemical polymers or particles are deposited in different spaces according to weights and sizes thereof, so that the various chemical polymers or particles can be prevented from reacting with each other.

* * * * *